US005973597A

United States Patent [19]

Hayashi

[11] Patent Number: 5,973,597

[45] Date of Patent: Oct. 26, 1999

[54] THEFT CHECKING SYSTEM

[75] Inventor: Michinari Hayashi, Nisshin, Japan

[73] Assignee: Maspro Denkoh, Co., Ltd., Aichi, Japan

[21] Appl. No.: 08/836,021

[22] PCT Filed: Aug. 27, 1996

[86] PCT No.: PCT/JP96/02397

§ 371 Date: Apr. 28, 1997

§ 102(e) Date: Apr. 28, 1997

[87] PCT Pub. No.: WO97/08672

PCT Pub. Date: Mar. 6, 1997

[51] Int. Cl.[6] ..... G08B 13/14

[52] U.S. Cl. ..... 340/572; 340/551

[58] Field of Search ..... 340/572, 551, 340/556, 527, 693; 343/742

[56] References Cited

U.S. PATENT DOCUMENTS 3,990,065 11/1976 Purinton et al. ..... 340/572
4,704,602 11/1987 Åsbrink ..... 340/572
4,727,360 2/1988 Ferguson et al. ..... 340/572
4,728,938 3/1988 Kaltner ..... 340/527
5,300,922 4/1994 Stoffer ..... 340/551
5,387,900 2/1995 Plonsky et al. ..... 340/572
5,414,410 5/1995 Davies et al. ..... 340/572
5,541,577 7/1996 Cooper et al. ..... 340/572

*Primary Examiner*—Jeffery A. Hofsass
*Assistant Examiner*—John Tweel, Jr.
*Attorney, Agent, or Firm*—Pearson & Pearson

[57] ABSTRACT

A theft checking system that improves precision in detecting a tagged article. A transmission antenna (1) transmits a signal of a constant amplitude in which sine-wave sweep is made within a range of 7.4 MHz to 8.9 MHz at 140 Hz. A reception side is provided with a signal analyzing portion (9) that predicts from the occurrence timing of a signal received within the first half period of a period of the sweep, the occurrence timing of a signal to be received within the second half period, and that compares a received signal with the predicted timing and, if it is confirmed that the signals are in an opposite phase relationship, recognizes passage of the article.

2 Claims, 3 Drawing Sheets

THEFT CHECKING SYSTEM

TECHNICAL FIELD

The present invention relates to a theft checking system wherein a tag incorporating a resonance circuit is attached to an article and, if the tagged article passes between transmission and reception antennas disposed facing each other, the resonance circuit picks up electromagnetic waves outputted from the transmission antenna and undergoes resonance, and the reception antenna receives the electromagnetic waves re-radiated from the resonance circuit, thereby detecting passage of the tagged article.

BACKGROUND ART

The theft checking system uses a short wave band centered at, for example, 8.2 MHz, and the electromagnetic waves radiated from the transmitter is weak so that it is susceptible to communication signals, electromagnetic waves from fluorescent lamps or office automation appliances, and the like, which intrude as noises.

The influence of noises can be reduced relatively easily by increasing the electromagnetic wave transmission power, increasing the resonance circuit in size, or reducing the detection area. However, an increase in the electromagnetic wave transmission power is only permitted within a limit, and a size increase of the resonance circuit results in a correspondingly increased size of the tag, which is unfavorable.

A reduction in the detection area will by no means be acceptable to consumers when the demand for enlarged detection areas is presently increasing.

Accordingly, a conventional technology is proposed, as described in, for example, Japanese Patent Laid-Open No. Sho 63-126094, wherein two types of resonance circuits having different resonance frequencies are incorporated in a tag, and the electromagnetic waves to be transmitted are subjected to sweeping, and if the re-radiated electromagnetic waves are received four times every period of sweep, validity is established and a detection signal is outputted.

The aforementioned technology achieves a high detection precision since it detects only re-radiated electromagnetic waves while ignoring eruptive noises. However, the tag doubles in size and thus offends the eye.

Moreover, if a signal indistinct from the resonance signal is detected four times within a period of sweep, the signal is detected as the resonance signal.

DISCLOSURE OF THE INVENTION

The present invention is a theft checking system that recognizes a difference between resonance signals and noises based on inter-period relationship of the number of occurrence and occurrence timing of signals detected within each of consecutive cycle periods, thereby reducing the possibility of errors to a minimum level. The system features a construction wherein a transmission antenna outputs electromagnetic waves of a constant amplitude in which periodical sweep is made between predetermined frequencies, and the resonant frequency of the resonance circuit is set so that it is lower than a frequency at the upper limit of the output electromagnetic waves and higher than a frequency corresponding to the lower limit thereof, and analysis means is provided for predicting from the occurrence timing of a signal received in the first half period of a period of the sweep, an occurrence timing of a signal to be received in the second half period, and for comparing a received signal with the predicted timing and, if it is confirmed that the signals are in an opposite phase relationship, recognizing passage of the article.

The sweep frequency of the electromagnetic waves transmitted from the transmission antenna is preferably a frequency such that detection can be made while a person is passing by walking between the transmission and reception antennas.

BRIEF DESCRIPTION OF THE INVENTION

BEST MODE FOR CARRYING OUT THE INVENTION

An embodiment of an theft checking apparatus according to the present invention will be described with reference to the drawings.

Figure 1:
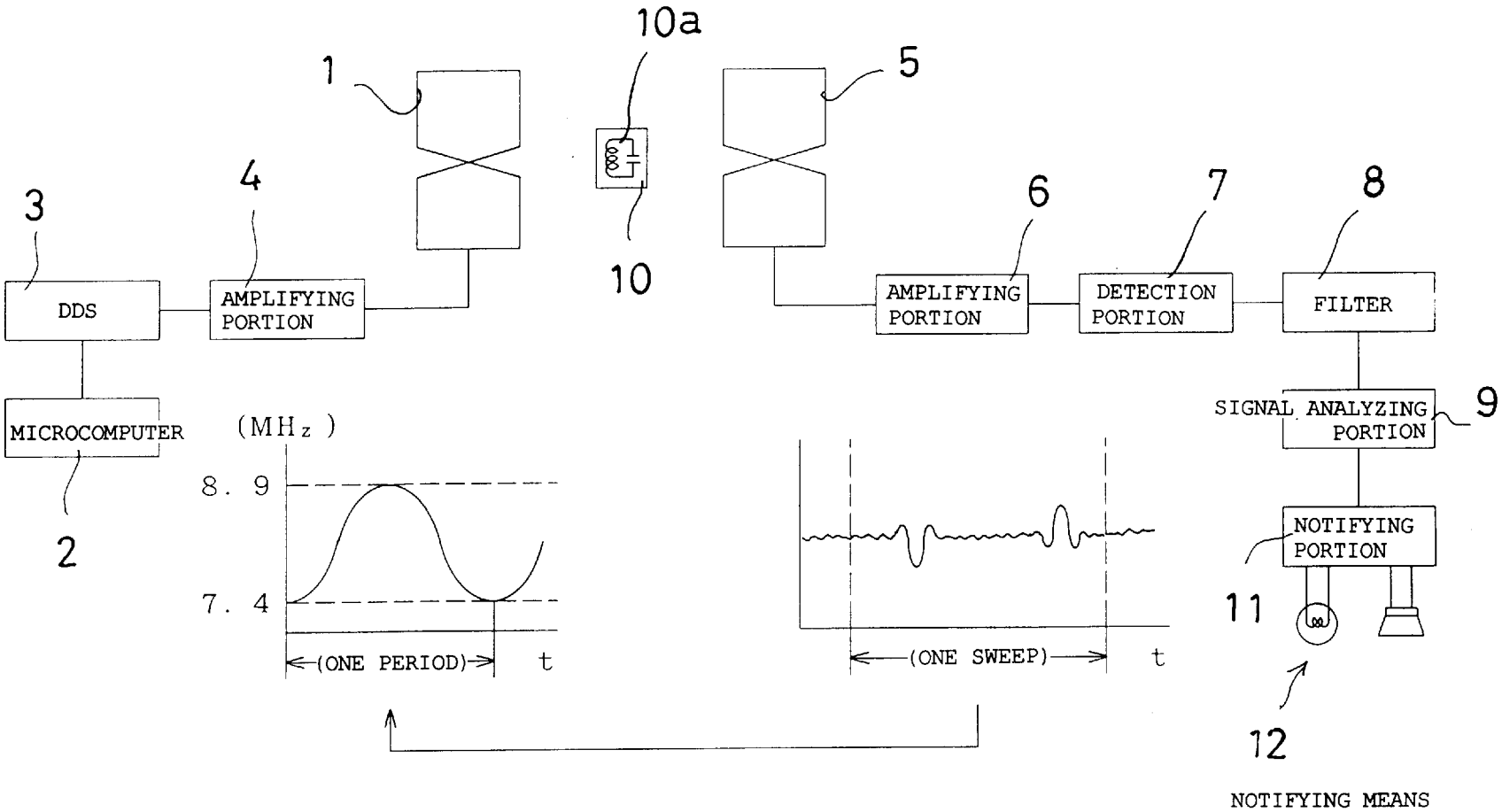
FIG. 1 is a block diagram illustrating a theft checking system according to the present invention.
Figure 2:
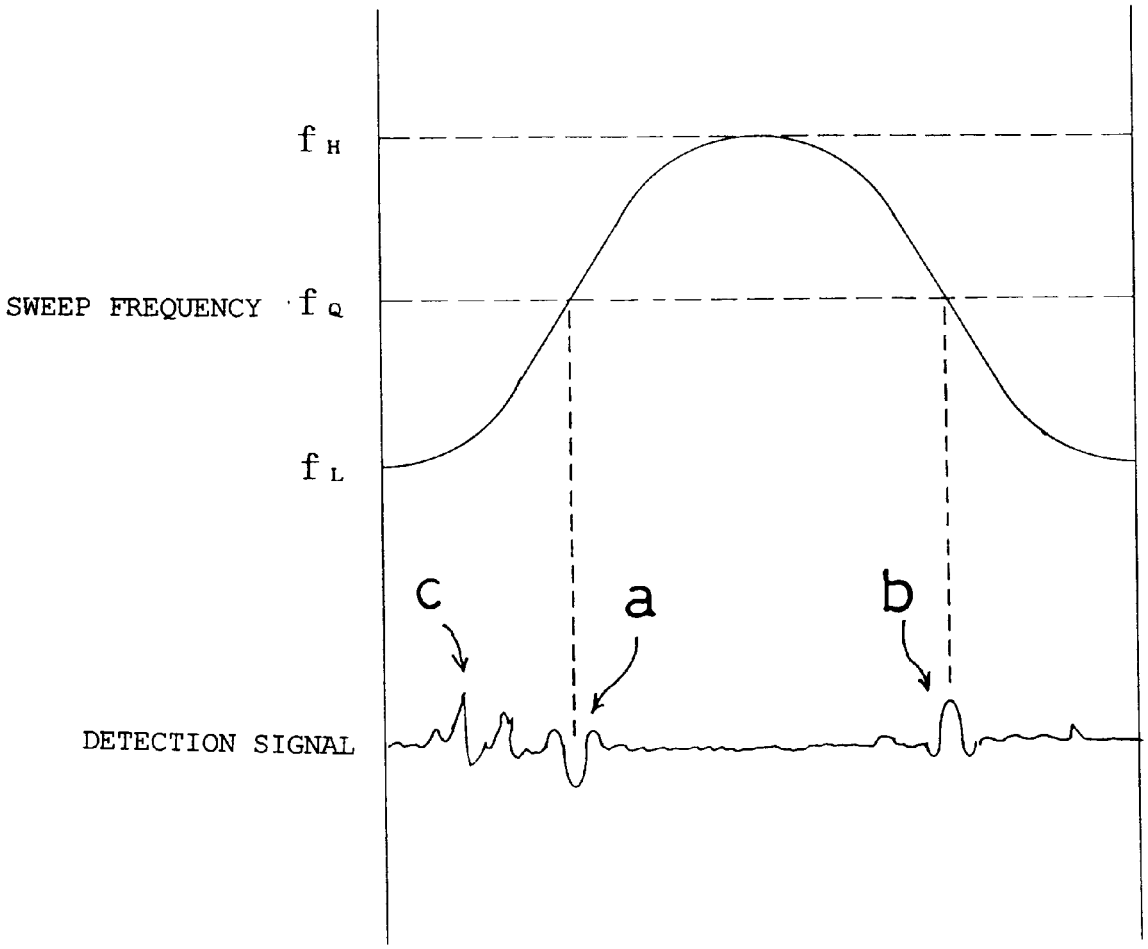
FIG. 2 is a diagram illustrating the analysis principle.

FIG. 1 illustrates an embodiment of a theft checking system according to the present invention, and FIG. 2 illustrates the principle of analysis means of the theft checking system. In accordance with an instruction from a computer (microcomputer) 2, a signal in which sine-wave sweep is made within a range of 7.4 MHz–8.9 MHz at 50 Hz is sent from a—DDS 3 through an amplifying portion 4 to a transmission antenna 1, which thereby radiates electromagnetic waves.

A reception antenna 5 receives electromagnetic waves radiated from the transmission antenna 1. The received signal is sent through an amplifying portion 6 to a detection portion 7, and the signal thereby detected is outputted through a band pass filter 8 to a signal analyzing portion 9.

When a tag 10 having a resonance circuit 10*a* comes in between the transmission antenna 1 and the reception antenna 5, a resonance signal is re-radiated from the tag 10, and the re-radiated electromagnetic waves and various noises are received by the reception antenna 5 together with electromagnetic waves radiated from the transmission antenna 1.

The transmission signal is a signal in which a sine-wave sweep is made within a range of 7.4 MHz–8.9 MHz at a frequency determined on the basis of the experiment results that are optimal for detection within a time of passage between the transmission and reception antenna at an average human walking speed, for example, 140 Hz. A resonance circuit whose resonant frequency $f_Q$ is set within the band undergoes resonance once in the first half period and once in the second half period of a period of the sweep as indicated in FIG. 2.

In addition, the resonance timing is regular. Therefore, the timing at which resonance occurs in the second half period can easily be predicted. The waveform at that timing becomes the opposite phase.

Figure 3:
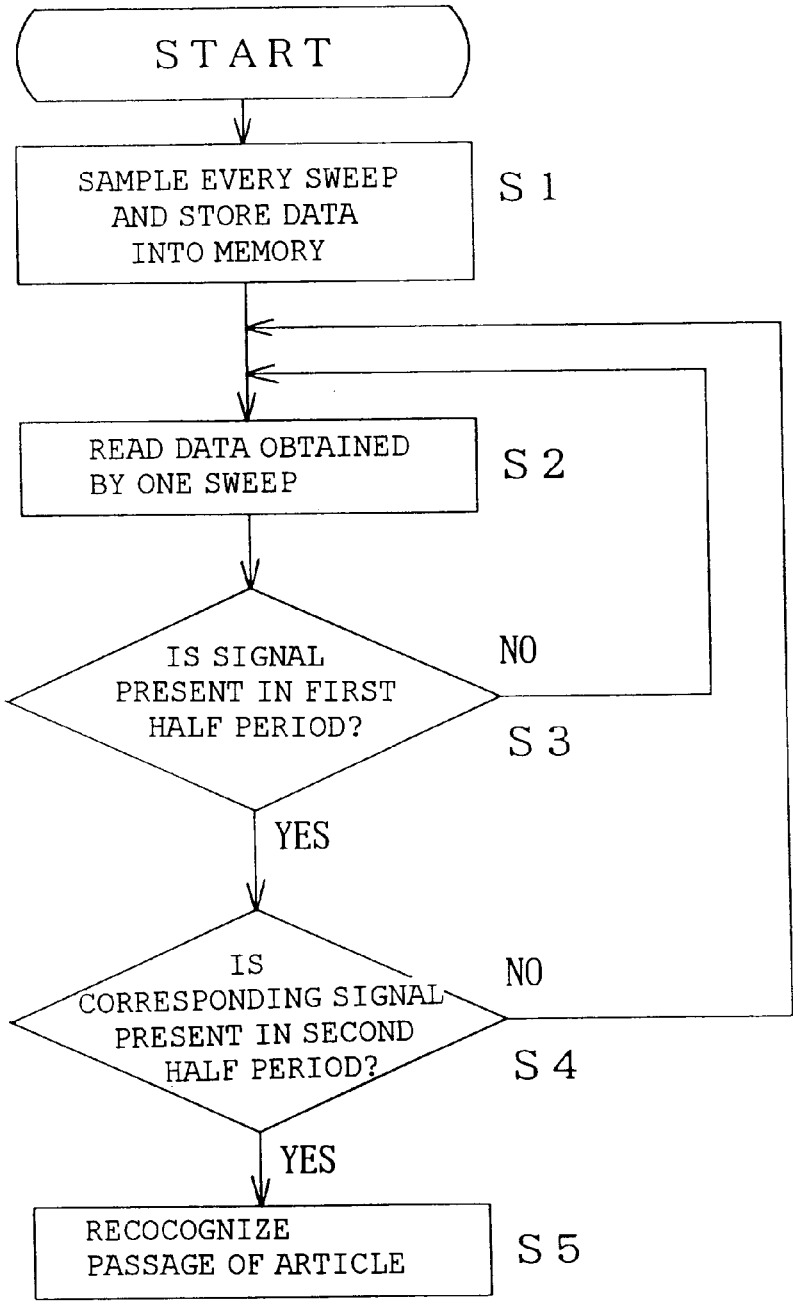
FIG. 3 is a flowchart illustrating the analysis processing.

The analyzing portion processes the received electromagnetic wave signal in accordance with, for example, the flowchart shown in FIG. 3.

First, S1 samples data from the detection signal for every sweep and stores the data into a memory. S2 reads data for a sweep that has been stored in the memory, and S3 searches for the presence of a signal in the first half of the data.

In a case where there is any signal, assuming that it is a resonance signal, the timing of a signal that should occur during the second half period is predicted from the signal received during the first half period, for example, a signal"a" indicated in FIG. 2. Based on the occurrence timing and phase of a signal detected during the second half, for example, a signal"b" indicated in FIG. 2, it is determined whether the signal"b" is a normal signal corresponding to the signal"a". If it is confirmed that it is a signal as predicted, S5 determines that they are resonance signals, and recognizes passage of an article, and causes the signal analyzing portion 9 to send a notifying portion 11 a signal indicating the presence of a tag. The notifying portion 11 produces an alarm using notifying means 12, for example, a lamp or a buzzer.

If S3 does not detect a signal, or if S4 does not identify a corresponding signal, the operation returns to S2, which reads data obtained by the next sweep and repeats execution of the analysis processing.

Therefore, if a signal indistinct from a resonance signal, for example, an indistinct signal"c" indicated in FIG. 2, is received during a first half period but a signal corresponding to that signal is not detected during the second half period, or, conversely, if a signal is received during a second half period but a signal is not detected during the first half period, or, if a signal is detected during each of the first and second half periods but the signal occurrence timing during the second half does not agree with the prediction, then such signals are regarded as noises and it is determined that passage of a tagged article is not observed.

Since only the resonance electromagnetic waves that occur twice in a sweep are reliably identified in this manner, a noise will not be mistaken for a resonance signal.

Moreover, since double checking is performed regarding occurrence timing and phase, the embodiment can safely be adopted even in environments where there are many noises hard to distinct from the resonance signal.

The phase checking is done by confirming that if peak values in a signal"a" occur in the order of, for example, A, B and C, the peak values in the signal"b" occur in the order of C, B and A.

The bands for the transmission frequency and the sweep frequency may be suitably changed. The resonance frequency $f_Q$ of the resonance circuit of a tag may also be freely set within a range that is lower than the frequency $f_H$ at the upper limit of the transmission electromagnetic waves and higher than the frequency $f_L$ corresponding to the lower limit thereof.

If the sweep frequency is set to an excessively high value, the pattern of resonance signal will deteriorate, making discrimination impossible. If it is excessively low, passage through the detection zone may be completed before completion of one period of sweep. Therefore, if a short-wave band is to be used, the practical sweep frequency would be 50 to one hundred and several tens Hz. However, the sweep frequency may be changed in accordance with the frequency of electromagnetic waves to be used.

The present invention predicts from the occurrence timing of a signal received within the first half period of a cycle of sweep, the occurrence timing of a signal to be received within the second half period, and makes comparison with the waveform received at the predicted timing, and, if it is confirmed that the waveforms are in an opposite phase relationship, determines that detection of a tag is valid. The present invention encompasses all the controls that use signal occurrence timing and phase as bases for determination, for example, a control that makes comparison in occurrence timing and phase between a signal received within the first half period of a cycle of sweep and a signal received within the second half period, and that determines that detection of a tag is valid if the two signals are opposite in phase and symmetrical about an intermediate point of the cycle.

Since any signal having no regularity in occurrence timing is determined as a noise regardless of whether reception occurs in a one-shot fashion or intermittently, the detection precision becomes very high.

Moreover, since a tag needs to contain only a single resonance circuit, miniaturization of a tag is facilitated.

Further, if a short wave is used by setting the sweep frequency to 50 to one hundred and several tens Hz, no deterioration of the signal distinguishing power will occur and there will be no possibility of escape from the detection area before completion of a sweep. Thus, the danger of detection error will be eliminated and the reliability will be high.

I claim:

1. A theft checking system wherein a tab incorporating a resonance circuit is attached to a monitor object article, and if the tagged article passes between transmission and reception antennas disposed facing each other, the resonance circuit picks up electromagnetic waves outputted from the transmission antenna and undergoes resonance, so that the reception antenna receives electromagnetic waves re-radiated from the resonance circuit, thereby detecting passage of the tagged article, said theft checking system wherein the transmission antenna outputs electromagnetic waves of a constant amplitude in which a periodical sweep is made between predetermined frequencies, and the resonant frequency of the resonance circuit is set so that it is lower than a frequency at the upper limit of the output electromagnetic waves and higher than a frequency corresponding to the lower limit thereof, and analysis means is provided for predicting from the occurrence timing of a signal received in the first half period of a period of the sweep, an occurrence timing of a signal to be received in the second half period, and for comparing a received signal with the predicted timing and, if it is confirmed that the signals are in an opposite phase relationship, recognizing passage of the article.

2. A theft checking system according to claim 1 wherein the electromagnetic waves transmitted from the transmission antenna are swept at a frequency such that detection can be made while a person is passing by walking between the transmission and reception antennas.

* * * * *